United States Patent [19]

Burchard, Jr.

[11] 4,058,339

[45] Nov. 15, 1977

[54] PIVOTAL LATCH FOR A SUCKER ROD PULLER

[76] Inventor: William Boyd Burchard, Jr., Box Y, Folsom, N. Mex. 88419

[21] Appl. No.: 667,874

[22] Filed: Mar. 17, 1976

[51] Int. Cl.[2] ..... B66C 1/00

[52] U.S. Cl. ..... 294/91; 403/331

[58] Field of Search ..... 294/91, 90, 92, 78 R, 294/82 R, 86 R, 102 A; 214/2.5, 249 A, 249 FD, 249 PC, 249 DP; 254/29 R, 30, 100, 133 R; 403/331

[56] References Cited

U.S. PATENT DOCUMENTS

| | | | |
|---|---|---|---|
| 243,859 | 7/1881 | Cushing | 403/331 |
| 1,592,706 | 7/1926 | Pridgen | 294/91 |
| 1,798,296 | 3/1931 | Yerkes et al. | 294/91 |
| 2,149,938 | 3/1939 | Hickman | 294/91 |
| 2,300,370 | 10/1942 | Lowery | 294/91 |
| 3,368,838 | 2/1968 | Reich | 294/90 |

*Primary Examiner*—James B. Marbert
*Attorney, Agent, or Firm*—Burton & Dorr

[57] ABSTRACT

A pivotal latch for a sucker rod puller is designed to be placed on a cross-member separating a first chamber being receptive of the collar of the sucker rod and a second chamber containing the latch. Slideably disposed over the main body containing the first and second chambers is a sleeve being of sufficient length to cover the first chamber and to uncover the second chamber when slideably disposed in a first position so that the pivotal latch automatically engages the end of the sleeve. The sleeve can be further slideably disposed in a second position over the second chamber thereby enabling the sucker rod collar to be removed from the first chamber and thereby holding the pivotal latch in a deactivated state against the inner surface of the sleeve.

15 Claims, 6 Drawing Figures

PIVOTAL LATCH FOR A SUCKER ROD PULLER

BACKGROUND OF THE INVENTION

1. Field of the Invention

The present invention relates generally to sucker rod pullers and more particularly to a sucker rod puller having a slideably disposed sleeve for preventing the collar of a sucker rod from releasing from the puller.

2. Description of the Prior Art

Sucker rod pullers have long been in use for elevating sucker rods from wells or the like. An early U.S. Pat. No. 243,859 issued to C. H. Cushing on July 5, 1881, discloses a typical sucker rod displaying swivel motion about a sucker rod puller having a slideably disposed sleeve for releasing and retaining the collar of the sucker rod therein.

The primary disadvantage with the above prior art approach is that the sleeve for retaining the collar of the sucker rod in the puller can be inadvertently slideably disposed upwardly thereby releasing the sucker rod when the sucker rod is pulled out from the well and lain on the ground by coming into contact with an abutting surface either in the well or on the ground.

Other conventional sucker rods have been connected to the puller by means of threaded connections. In these approaches before each section of the rod can be installed or removed, it is necessary to thread together or partially thread these connections. This threading operation is inherent with the problem of disengaging the bottom section of the sucker rod and, sometimes, with the result that the sucker rod falls all the way to the bottom of the well. Fishing out the sucker rod from the bottom of the well is a time consuming and expensive process.

The present invention overcomes the disadvantages of the prior art approaches by providing a pivotal detent or latch that automatically biases the slideable sleeve into position so that inadvertent or accidental release of the sucker rod is prevented. In the event that the sucker rod is to be removed from the sucker rod puller, the pivotal detent is manually deactivated to allow manual retraction of the sleeve to a position for releasing the collar of the sucker rod.

OBJECTS OF THE INVENTION

It is an object of the present invention to provide a new and improved puller for attachment to sucker rods.

It is another object of the present invention to provide a sucker rod puller having a slideable sleeve automatically latched into place for containing the collar of a sucker rod.

It is another object of the present invention to provide a sucker rod puller having means attached thereto for connecting to an elevator, a latch having activated and deactivated states, a main body having first and second chambers formed therein with the first chamber having an opening receptive of the collar for a sucker rod and a second chamber having an opening for containing the latch, and a sleeve slideably disposed over the main body wherein the sleeve is held in a first position by the activated state of the latch over the first chamber for containing the collar of the sucker rod and being capable of being manually retained over the second chamber thereby maintaining the latch in a deactivated state so that the collar of the sucker rod can be selectively removed or released therefrom.

It is still a further object of the present invention to provide a sucker rod puller having means for elevating a sucker rod, a spring biased pivotal detent latch having activated and deactivated states, a main body of substantially quadrilateral transverse cross-section having a first chamber formed in a first longitudinal end opposing the connection to the elevating means and a second chamber formed in a second longitudinal end connecting to the elevating means, the first chamber being receptive of the collar of the sucker rod and the second chamber containing the spring biased detent, and a sleeve of substantially quadrilateral transverse cross-section slideably disposed over the main body being of sufficient length to cover the first chamber opening in a first position so that the latch automatically engages the end of the sleeve in order to prevent the sleeve from movement and to cover the second chamber opening in a second position thereby opening the first chamber to allow release of the collar of the sucker rod and to maintain the latch in the deactivated state.

It is still another object of the present invention to provide a sucker rod puller of simplified construction which is sturdy and reliable in operation.

SUMMARY OF THE INVENTION

The present invention comprises a durable, compact sucker rod puller which quickly and easily releasably holds a conventional sucker rod and includes a sleeve retaining the collar of the sucker rod and a pivotal detent or latch for positively latching the sleeve in position in order to retain the collar of the sucker rod. The sucker rod puller of the present invention includes a main body portion of substantially quadrilateral transverse cross-section having a first chamber formed in the first longitudinal end opposing the connection of the main body to an elevating means and a second chamber formed in the second longitudinal end of the main body which connects to the elevating means. The first chamber includes an opening receptive of the collar of the sucker rod, and the second chamber is separated from the first chamber by means of a cross-member upon which the pivotal latch is mounted in the second chamber. A sleeve of substantially quadrilateral transverse cross-section is slideably disposed over the main body and is of sufficient longitudinal length so that when the sleeve covers the first chamber so as to retain the collar of the sucker rod the second chamber opening is not covered so that the spring biased latch automatically engages the sleeve to prevent the sleeve from longitudinal movement along the main body portion. When the latch is manually retracted, the sleeve can be manually disposed over the second chamber to hold the latch in the deactivated state and to allow the release of the collar of the sucker rod from the puller. The main body portion further includes a shoulder integral with and protruding out from the first end of the main body portion for abutting the sleeve thereby preventing movement of the sleeve off from the main body portion and it further includes an outward protrusion on the second end of the main body portion for preventing movement of the sleeve off from that end.

Other objects, advantages and capabilities of the present invention will become more apparent as the description proceeds taken in conjunction with the accompanying drawings.

DESCRIPTION OF THE PREFERRED EMBODIMENT

Figure 1:
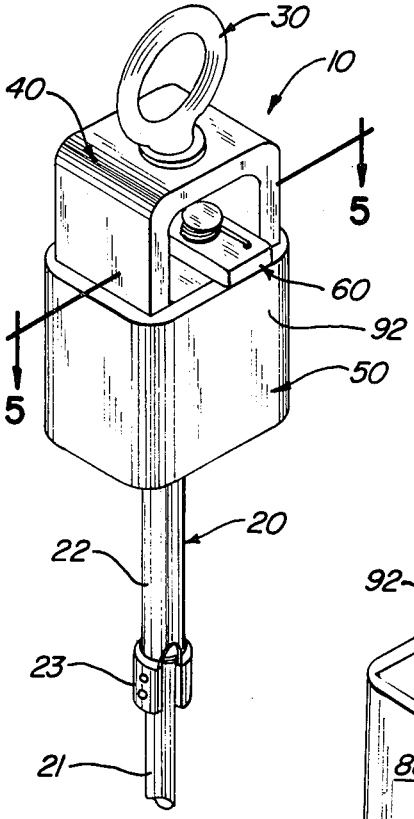
FIG. 1 is a perspective view of the sucker rod puller of the present invention with the slideable sleeve retaining a sucker rod in the interior of the puller and illustrating the pivotal latch of the present invention in the activated state.
Figure 2:
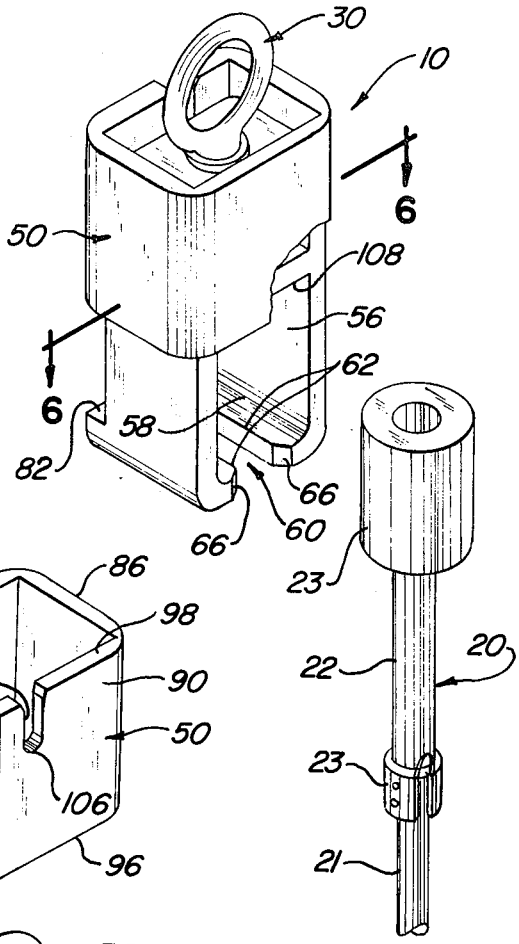
FIG. 2 is a perspective view similar to the view of FIG. 1 but showing the sleeve disposed in an upward position thereby allowing the collar of the sucker rod to be releasably removed from the puller.

Referring now to FIG. 1, the sucker rod puller 10 of the present invention is shown retaining a conventional sucker rod 20. The sucker rod puller 10 includes means 30 for elevating the sucker rod puller 10, a main body portion 40, a slideable sleeve 50 disposed over the main body portion 40 for retaining the sucker rod, and a pivotal latch or detent 60 for latching the sleeve 50 over the sucker rod 20. In FIG. 2, the sucker rod 20 is shown released from the sucker rod puller 10.

Before discussing the various details and features of the sucker rod puller 10 of the present invention, it is necessary first to present briefly the structural characteristics of the sucker rod 20. The sucker rod 20 may comprise any of a number of conventional shapes and configurations. The preferable sucker rod 20 shown in FIG. 2 includes the rod 21, a neck 22 being affixed to the sucker rod 21 by a conventional connector 23, and a cylindrically shaped collar 23 connected to the upper portion of the neck 22. It is to be understood that the collar 23, and the neck 22 are firmly affixed and attached to each other and to the rod 21 in order to withstand tremendous stresses as the rod 21 is lifted and jerked into and out from a well.

Figure 3:
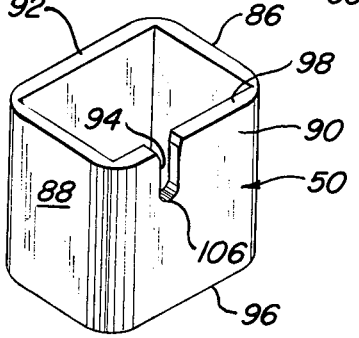
FIG. 3 is an exploded view of the various components comprising the sucker rod puller of the present invention.
Figure 3:
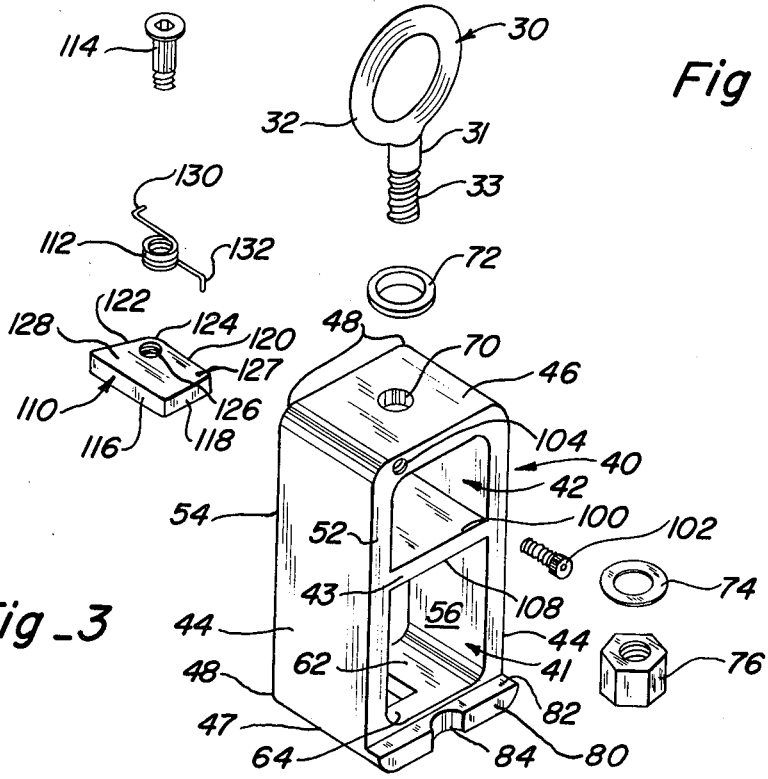

The elevating means 20, as shown in FIG. 3, comprises pin 31 which has an upper eyelet portion 32 and a lower threaded stud portion 33. The elevating means 30 is attached to the upper end of the main body 40 in a manner to be later discussed in detail. It is to be understood that any conventional means for elevating sucker rod pullers may be utilized and attached to the main body portion 40 of the sucker rod puller 10 of the present invention.

The main body portion 40 as shown in FIG. 3 comprises a formed structure having a lower first chamber 41 and an upper second chamber 42 separated by a cross-member 43. The main body 40 is of substantially quadrilateral transverse cross-section having longitudinal sides 44 and flat parallel ends 46 and 47. The corners 48 of the main body portion 40 are rounded. The front and rear ends 52 and 54, respectively, are flat and substantially parallel to each other. The first chamber 41 is formed through the main body portion 40 from an opening in the front wall 52 therethrough to a corresponding opening in the rear wall 54. The sides 56 of the first chamber 41 terminate in a bend in the bottom end 47 of the main body 40. The bottom end 47 has a mouth 60 formed therein as shown in FIGS. 2 and 3 in order to define shoulders or supporting jaws 62. The mouth 60 extends towards the front wall 52 and terminates in a shoulder 64. The mouth 60 extends through to the rear wall 54 in beveled relationship 66 therewith. The width of the mouth 60 is slightly greater than the diameter of the neck 22 of the sucker rod 20. The first chamber 41 extends upwardly from the bottom end wall 47, preferably in the range of ½ to ¾ the longitudinal length of the main body portion 40, and terminates in the cross-member 43. The distance between the opposing sides 56 of the chamber 41 is slightly greater than the diameter of the collar 23 of the sucker rod 20. In a manner which will be more fully explained in the ensuing, the first chamber 41 is receptive of the collar 23 of the sucker rod 20 and the mouth 60 formed in the bottom end 47 of the main body portion 40 is receptive of the neck 22 of the sucker rod assembly 20.

Figure 4:
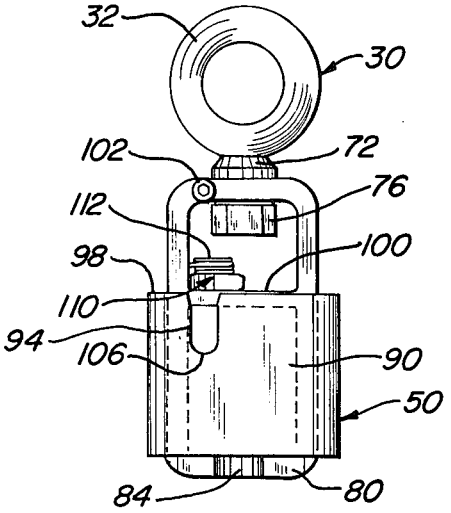
FIG. 4 is a side planar view of the sucker rod puller of the present invention.

The second formed chamber 42 is disposed above the first chamber 41 and the cross-member 43. The second chamber 42 is formed to extend from an opening in the front wall 52 to a correspondingly shaped opening in the rear wall 54 of the main body portion 40, as shown in FIG. 3. Formed through the upper end 46 of the main body portion 40 and into the chamber 42 is a hole or passageway 70 through which the threaded stud 33 of the eyelet pin 30 is inserted. Disposed between the eyelet pin 30 and the main body portion 40 is a washer 72 as shown in FIG. 3. Disposed over the inserted threaded stud portion 33 and in the interior of the chamber 42 is a second washer 74. A nut 76 with hexagonal wrench pads engages the threaded stud portion 33 of the eyelet pin 30 and firmly tightens the eyelet stud 30 to the main body portion 40 thereby securing the pin to the sucker rod puller 10 as shown in FIG. 4. The cross-member 43 has parallel opposing flat surfaces 100 and 108 and is integral with sides 44 of the main body 40.

Protruding outwardly from the bottom end 47 and from the front wall 52 of the main body portion 40 is a protruding lip 80 having a flat upper shoulder 82 defined thereon. An arcuate cavity 84 is formed in the center of this lip 80. As will be more fully discussed ensuing, the shoulder 82 of the protruding lip 80 serves as a stop to longitudinal movement of the slideable sleeve 50.

The sleeve 50 is also of substantially quadrilateral transverse cross-section and is slideably disposed over the main body 40. The inner configuration of sleeve 50 substantially corresponds to the outer configuration of the main body portion 40. As shown in FIG. 1, sleeve 50 is slideably disposed over the main body 40 and is in close relationship thereto. The sleeve 50 includes side walls 86 and 88, front wall 90 and rear wall 92. In front wall 90 of sleeve 50 is formed an elongated travel stop slot 94 whose purpose will become more apparent in a later discussion.

The longitudinal length of the sleeve 50 substantially corresponds to the longitudinal height of the chamber 41 so than when the sleeve 50 is disposed over the main body portion 40 and when the bottom edge 96 of the front wall 90 abuts shoulder 82 of protruding lip 80, the top edge of the sleeve 98 substantially lays in the same plane as the uppermost surface 100 of the cross-member 43 as shown in FIG. 4. It is apparent that the protruding lip 80 prevents the sleeve 50 from falling off from the main body portion 40 and serves to stop and limit the movement of the sleeve 50 about the longitudinal length of the body portion 40. After the sleeve 50 is disposed over the body portion 40 so that the sleeve 50 has face 90 in the same orientation as the protruding lip 80 of the main body portion 40, a socket head knurled screw 102 is inserted into a correspondingly threaded hole or passageway 104 in the main body portion. The screw 102 fully engages the passageway 104 so that the knurled head is the only portion of the screw that protrudes from the body 40, as shown in FIG. 4. The screw 102 is in line with the longitudinal travel stop slot 94 and when the end 106 of the longitudinal travel stop slop 94 abuts the screw 102, as is represented in FIG. 2, the sleeve 50 is prevented from further upward longitudinal movement along the elongated main body portion 40. It is to be noted that the length of the travel stop slot 94 is sufficiently long enough to enable the bottom edge 96 of the sleeve 50 to substantially lay in the same plane as the bottom edge 108 of the cross-member 43 as is represented in FIG. 2.

The pivotal latch or detent 60 includes a detent member 110, a wire spring 112 and a socket head pin screw 114. The detent member 110 includes two mutually perpendicular horizontal sides 116 and 118, and two opposing angular sides 120 and 122. Side 122 forms a substantially acute angle with side 110 and further terminates in an arcuate bend 124 which is integral with side 120. Side 120 is substantially perpendicular to side 118. Formed therein and disposed therethrough is a passageway 126 in close parallel spaced relationship to the bend 124. Additionally, a hook catch cavity 126 is formed in the surface 128 of the detent 110.

Wire spring 112 is conventional and includes two hook ends 130 and 132 wherein hook end 130 is disposed in a plane substantially perpendicular to the plane of hook end 132. The wire spring is preferably made from spring steel.

Figure 5:
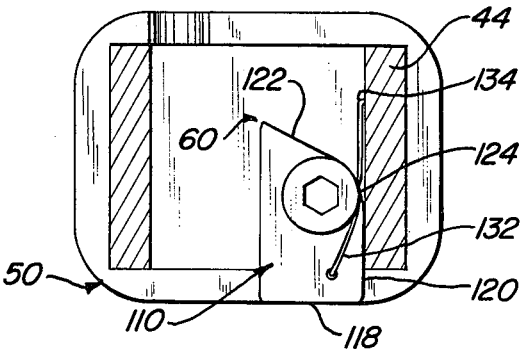
FIG. 5 is a sectional view taken along lines 5—5 in FIG. 1 showing the latch of the present invention in the activated state.

The latch 60 is designed to be mounted to the upper surface 100 of the cross-member 43 of the main body portion 40 as is shown in FIGS. 1 and 4 through 6. The socket head pin screw 114 threadedly engages a correspondingly threaded passageway, not shown, in the cross-member 43. To firmly position the spring 112 in the upper surface 128 of the detent member 110, the downwardly pointing end 132 of the wire spring 112 hooks into catch 126 of the detent 110 and end 130 of the spring engages a hook catch 134, as shown in FIG. 5.

Figure 6:
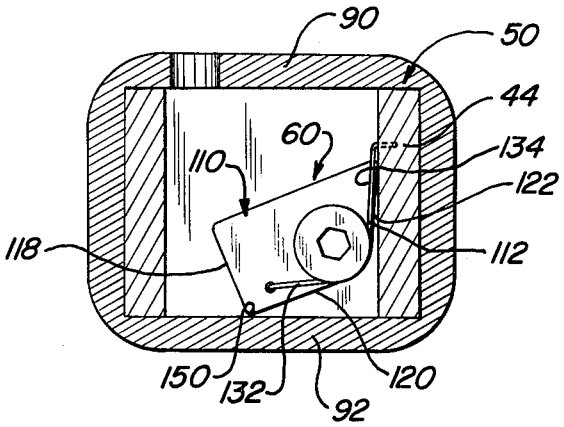
FIG. 6 is a sectional view along line 6—6 of FIG. 2 showing the latch of the present invention in the deactivated state.

The operation of the sucker rod puller 10 of the present invention will now be discussed. Assuming the sucker rod puller 10 of the present invention is initially in the position as shown in FIG. 2, the sucker rod 20 is inserted into chamber 41 by inserting the neck 22 into the mouth 60 and resting the bottom portion of the collar 23 onto jaws 62 and 64. At this point in time, the latch 60 is biased against the compressive force of the wire spring 112 in the position as indicated in FIG. 6. Side 122 of the detent member 110 substantially abuts the inner surface of side wall 44 in chamber 42. The corner 150 between sides 118 and 120 abuts the inner surface of the rear wall 92 of the sleeve 50.

When the sleeve 50 is manually retracted downwardly along the longitudinal length of the body member 40 to abut shoulder 82 of protruding lip 80, the upper surface 98 of the sleeve 50 lays substantially in the same plane as the upper surface 100 of the cross-member 43 as shown in FIG. 4. In this position, as shown in FIG. 5, the detent member 110 under bias force of the wire spring 112 travels outwardly from chamber 42 so that side 120 of the detent member 110 abuts the inner surface of wall 44 substantially along the side 120. While the detent member 110 travels from the position indicated in FIG. 6 to the position indicated in FIG. 5, the bend 124 between sides 120 and 122 of detent member 110 pivots abut the inner surface of wall 44. As shown in FIG. 1, in this position wall 118 of the detent member 110 lays substantially in the same plane as the outer surface of rear wall 92 of sleeve 50. In this position, the detent member 110 firmly engages edge 98 of sleeve 50 to prevent sleeve 50 from longitudinal movement along the longitudinal axis of the main body 40 and to maintain the sleeve in abutting engagement with lip 80. The collar 23 of the sucker rod 20 is now firmly retained in cavity 41 of the main body member 40. When it is desired to remove the sucker rod assembly 20 from cavity 41, the latch 60 is manually held into the deactivated position as shown in FIG. 6, and the sleeve 50 is manually tracted upwardly to a position as shown in FIG. 2.

Although the present invention has been described with a certain degree of particularity, it is understood that the present disclosure has been made by way of example and that changes in details of structure may be made without departing from the spirit thereof.

What is claimed is:

1. A sucker rod puller having means attached thereto for connecting to a means for elevating the sucker rod, said sucker rod puller comprising:

a latch having activated and deactivated states, a main body receptive of said sucker rod, said latch being disposed in said main body in the deactivated state and a sleeve over said main body, said sleeve being held in a first position by said activated state of said latch for containing said sucker rod and capable of being manually retained in a second position for maintaining said latch in said deactivated state, said sleeve defining the outer perimeter of said puller in said activated and deactivated states and said latch being inward of said perimeter in said activated state.

2. The sucker rod puller of claim 1 in which said main body is of substantially quadrilateral transverse cross-section having a first chamber formed beneath said elevating means in a first longitudinal end of said main body opposing said connection to said elevating means and a second chamber formed in the second longitudinal end of said main body connecting to said elevating means.

3. The sucker rod puller of claim 2 in which said sleeve is of substantially quadrilateral transverse cross-section and is slideably disposed over said main body, said sleeve being of sufficient length to cover said first chamber opening and to uncover said second chamber opening when slideably disposed in said first position over said first end of said main body and to cover said second chamber opening and to uncover said first chamber opening when slideably disposed in said second position over said second end of said main body.

4. The sucker rod puller of claim 3 further comprising first means on said first longitudinal end for stopping said sleeve from sliding off said main body and second means on said second longitudinal end for stopping said sleeve from sliding off said main body.

5. The sucker rod puller of claim 4 in which said first stopping means comprises a shoulder integral with and protruding out from said first end of said main body for abutting said sleeve.

6. The sucker rod puller of claim 4 in which said second stopping means comprises an outward protrusion on said second end of said main body for engaging a longitudinal slot formed in said sleeve.

7. The sucker rod puller of claim 3 in which said latch automatically engages said sleeve in said activated state when said sleeve is slideably disposed in said first position for preventing longitudinal movement of said sleeve along said main body and in which said latch is held in said deactivated state when said sleeve is slideably disposed in said second position.

8. A sucker rod puller having means attached thereto for connecting to a means for elevating the sucker rod, said sucker rod puller comprising:

a latch having activated and deactivated states, a main body receptive of said sucker rod and containing said latch, and a sleeve over said main body, said sleeve being held in a first position by said activated state of said latch for containing said sucker rod and capable of being manually retained in a second position for maintaining said latch in said deactivated state, said latch having a pivotal detent for engaging said sleeve in said activated state and for abutting the interior surface of said sleeve in said deactivated state.

9. The sucker rod puller of claim 8 in which said pivotal detent is spring biased to automatically activate into said first state when said sleeve is over said first chamber.

10. The sucker rod puller of claim 1 further comprising a cross-member separating said first chamber from said second chamber.

11. The sucker rod puller of claim 7 in which said latch is pivotally mounted on said cross-member in said second chamber.

12. A sucker rod puller having means attached thereto for connecting to a means for elevating the sucker rod, said sucker rod puller comprising:

a spring biased pivotal detent latch having activated and deactivated states, a main body of substantially quadrilateral transverse cross-section having a first chamber formed in the first longitudinal end opposing said connection to said elevating means and a second chamber formed in the second longitudinal end connecting to said elevating means, said first chamber having an opening receptive of said sucker rod and said second chamber having an opening containing said latch, and a sleeve of substantially quadrilateral transverse cross-section slideably disposed over said main body, said sleeve being of sufficient length to cover said first chamber opening and to uncover said second chamber opening when slideably disposed in said first position over said first end of said main body and to cover said second chamber opening and to uncover said first chamber opening when slideably disposed in said second position over said second end of said main body, said latch automatically engaging said sleeve in said activated state when said sleeve is slideably disposed in said first position for preventing longitudinal movement of said sleeve along said main body and in which said latch is held in said deactivated state when said sleeve is slideably disposed in said second position.

13. The sucker rod puller of claim 12 further comprising a cross-member separating said first chamber from said second chamber.

14. The sucker rod puller of claim 13 in which said latch is pivotally mounted on said cross-member in said second chamber.

15. The sucker rod puller of claim 12 further comprising a shoulder integral with and protruding out from said first end of said main body for abutting said sleeve and an outward protrusion on said second end of said main body for engaging a longitudinal slot formed in said sleeve.

* * * * *